US008191640B2

(12) United States Patent
McCreedy et al.

(10) Patent No.: US 8,191,640 B2
(45) Date of Patent: Jun. 5, 2012

(54) UNIVERSAL PUMP HOLDDOWN SYSTEM

(75) Inventors: Paul McCreedy, Calgary (CA); Ray Neudorf, Swift Current (CA)

(73) Assignee: Smith International, Inc., Houston, TX (US)

( * ) Notice: Subject to any disclaimer, the term of this patent is extended or adjusted under 35 U.S.C. 154(b) by 270 days.

(21) Appl. No.: 12/480,433

(22) Filed: Jun. 8, 2009

(65) Prior Publication Data

US 2009/0301705 A1 Dec. 10, 2009

(30) Foreign Application Priority Data

Jun. 9, 2008 (CA) ..... 2634508

(51) Int. Cl.
*E21B 23/02* (2006.01)
*E21B 23/00* (2006.01)
*E21B 17/10* (2006.01)

(52) U.S. Cl. ..... 166/382; 166/241.1; 166/105

(58) Field of Classification Search ..... 166/382, 166/241.1, 105; 417/360, 423.15
See application file for complete search history.

(56) References Cited

U.S. PATENT DOCUMENTS 3,347,169 A 10/1967 Cronin, Jr. et al.
4,121,659 A 10/1978 Taylor
4,171,934 A 10/1979 Zehren
4,363,359 A * 12/1982 Taylor et al. ..... 166/214
4,592,427 A 6/1986 Morgan
4,749,341 A 6/1988 Bayh, III
4,913,239 A 4/1990 Bayh, III
5,685,370 A 11/1997 Smith, Jr. et al.
5,746,582 A 5/1998 Patterson
6,202,746 B1 3/2001 Vandenberg et al.
6,695,060 B1 2/2004 Guidry, Jr. et al.
6,729,391 B2 5/2004 Hill et al.

FOREIGN PATENT DOCUMENTS

CA 1324167 11/1993
CA 2310198 A1 11/2001

OTHER PUBLICATIONS

Examination Report issued in corresponding Canadian Patent Application No. 2,634,508; dated Sep. 20, 2010 (2 pages).
Examination Report issued in corresponding Canadian Application No. 2,634,508; Dated Jun. 8, 2011 (2 pages).

* cited by examiner

*Primary Examiner* — Cathleen Hutchins
(74) *Attorney, Agent, or Firm* — Osha Liang LLP

(57) ABSTRACT

A pump seating nipple is provided for engagement with a downhole pump in order to seal and anchor the downhole pump relative to the pump seating nipple. The pump seating nipple includes a nipple sealing component for coupling with the downhole pump to provide a seal device, a nipple axial force anchoring component for coupling with the downhole pump to provide an axial force anchor device, and a nipple rotational force anchoring component for coupling with the downhole pump to provide a rotational force anchor device.

38 Claims, 3 Drawing Sheets

UNIVERSAL PUMP HOLDDOWN SYSTEM

CROSS-REFERENCE TO RELATED APPLICATIONS

This application claims benefit of Canadian Patent Application 2,634,508 filed on Jun. 9, 2008, and entitled "universal Pump Holddown System," which is hereby incorporated herein by reference in its entirety for all purposes.

STATEMENT REGARDING FEDERALLY SPONSORED RESEARCH OR DEVELOPMENT

Not applicable.

BACKGROUND

The present disclosure relates to a holddown system for an insertable downhole pump, which system may be used in conjunction with both reciprocating and rotary downhole pumps. Further, the present disclosure relates to a pump seating nipple for engagement with a reciprocating or a rotary downhole pump in order to seal and anchor the downhole pump relative to the pump seating nipple. As well, the present disclosure relates to a system for connecting a rotary downhole pump with a pump seating nipple, having a rotational force anchor device.

Various types of reciprocating and rotary pumps are often required to be placed downhole in a borehole or wellbore in order to permit the pumping or production of fluids to the surface. In some of these downhole pumps, the pump is attached to a lower end of a tubing string or production tubing, which is then inserted through the borehole to a desired position. When it is desired to remove this type of downhole pump for any purpose, the entire tubing string must be retrieved from the borehole with the pump.

As a result, insertable downhole pumps have been developed. Specifically, these downhole pumps are insertable through the tubing string to the desired position in the borehole. In order to provide for the placement of the insertable downhole pump, the tubing string typically includes a compatible downhole pump seating nipple. Thus, the pump is inserted through the tubing string for seating or landing in the seating nipple. When it is desired to remove the insertable pump for any purpose, the pump is simply retrieved to the surface. In other words, the pump may be retrieved without removal of the tubing string.

However, insertable pumps may be either of a reciprocating type, such as a reciprocating rod pump, or a rotary type, such as a progressing cavity pump. Reciprocating-type downhole pumps are required to be held or anchored by the seating nipple against axial or longitudinal movement during operation of the reciprocating pump. Rotating-type downhole pumps are required to be held or anchored by the seating nipple against rotational movement during operation of the reciprocating pump.

Accordingly, the pump seating nipple is configured to be compatible for use with the particular reciprocating or rotary downhole pump. As a result, when it is desired to remove an insertable pump of one type for replacement with an insertable pump of the alternate type, the tubing string is required to be retrieved to the surface such that a compatible pump seating nipple may be connected into the tubing string.

Various pump holddown systems, including pump seating nipples, have been developed for insertable reciprocating or rotary pumps. Nevertheless, there is a need in the industry for an improved pump holddown system for insertable downhole pumps, including an improved pump seating nipple. In particular, there is a need for a pump seating nipple which may be utilized with both reciprocating and rotary downhole pumps. Further, there is a need for an improved system for connecting a rotary downhole pump with a pump seating nipple.

SUMMARY OF THE DISCLOSURE

The present disclosure relates to a pump seating nipple for engagement with a downhole pump, being a reciprocating pump or a rotary pump, and to a system for connecting a rotary downhole pump with a pump seating nipple.

Preferably, the pump seating nipple is configured for receiving the downhole pump in order to anchor the downhole pump relative to the pump seating nipple. Preferably, the pump seating nipple is further configured for receiving the downhole pump in order to seal the downhole pump relative to the pump seating nipple. Thus, in some embodiments, the pump seating nipple receives and engages the downhole pump in a manner in order to seal and anchor the downhole pump.

Further, the pump seating nipple is configured or adapted to be compatible for use with either a reciprocating or a rotary downhole pump. Preferably, the pump seating nipple is configured or adapted to be compatible with both a reciprocating downhole pump and a rotary downhole pump. In other words, the pump seating nipple is capable of interchangeably receiving or accommodating either a reciprocating pump or a rotary pump.

The reciprocating downhole pump may be any insertable reciprocating-type pump, such as a reciprocating rod pump, compatible for use with the pump seating nipple and requiring anchoring to restrain axial movement of the pump during operation. The rotary downhole pump may be any insertable rotary-type pump, such as a progressing cavity pump, compatible for use with the pump seating nipple and requiring anchoring to restrain rotational movement of the pump during operation.

When a reciprocating downhole pump is engaged with the pump seating nipple, the pump seating nipple resists or restrains axial movement of the downhole pump relative to the pump seating nipple. When a rotary downhole pump is engaged with the pump seating nipple, the pump seating nipple resists or restrains rotational movement of the downhole pump relative to the pump seating nipple.

Further, the downhole pulp and the pump seating nipple may be adapted and assembled to provide for either a top hold down configuration or top anchoring of the downhole pump, or a bottom holddown configuration or bottom anchoring of the downhole pump. Preferably, a bottom hold down configuration is provided.

One embodiment disclosed herein includes a pump seating nipple for engagement with a downhole pump in order to seal and anchor the downhole pump relative to the pump seating nipple, wherein the downhole pump is a reciprocating pump or a rotary pump, the pump seating nipple having a proximal end, a distal end, and an internal surface defining a bore extending between the proximal end and the distal end for receiving the downhole pump, the pump seating nipple including:

(a) a nipple sealing component associated with the internal surface, for cooperating with a complementary pump sealing component associated with the downhole pump in order to provide a seal device between the pump seating nipple and the downhole pump;

(b) a nipple axial force anchoring component associated with the internal surface, for cooperating with a complementary pump axial force anchoring component associated with the downhole pump in order to provide an axial force anchor device for resisting axial movement of the downhole pump relative to the pump seating nipple; and (c) a nipple rotational force anchoring component associated with the internal surface, for cooperating with a complementary pump rotational force anchoring component associated with the downhole pump in order to provide a rotational force anchor device for resisting rotational movement of the downhole pump relative to the pump seating nipple.

As indicated, the pump seating nipple has a proximal end, a distal end, and an internal surface defining a bore extending between the proximal end and the distal end for receiving the downhole pump. The pump seating nipple may include a single integrally formed member or pipe providing or defining each of the nipple sealing component, the nipple axial force anchoring component and the nipple rotational force anchoring component. Alternately, the pump seating nipple may include one or more members or pipes which are mounted, fastened or otherwise connected together, permanently or detachably, to provide or define each of the nipple sealing component, the nipple axial force anchoring component and the nipple rotational force anchoring component.

In another embodiment, a system for connecting a rotary downhole pump with a pump seating nipple includes a rotational force anchor device for resisting rotational movement of the downhole pump relative to the pump seating nipple. The system may further include a seal device for providing a seal between the pump seating nipple and the downhole pump. The system may also further include an axial force anchor device for resisting axial movement of the downhole pump relative to the pump seating nipple.

In each of the system and the pump seating nipple, the seal device may include any sealing elements, members or components and may have any configuration capable of, and suitable for, providing a sealing function between the pump seating nipple and the downhole pump. In some embodiments, the seal device includes a sealing member associated with one of the pump seating nipple and the downhole pump and a complementary sealing surface associated with the other of the pump seating nipple and the downhole pump.

Thus, in some embodiments, the seal device includes a sealing member and a complementary sealing surface, wherein the nipple sealing component includes either the sealing member or the sealing surface. Thus, the pump sealing component includes the other of the sealing member and the sealing surface. Preferably, the nipple sealing component includes the sealing surface. Further, the sealing surface is preferably associated with the internal surface of the pump seating nipple. Accordingly, the pump sealing component includes the sealing member. Thus, the sealing member is associated with the downhole pump, preferably the external surface of the downhole pump.

The sealing member may include one or a plurality of seals or sealing mechanisms capable of sealing between the pump seating nipple and the downhole pump. For instance, the sealing member may include one or more bushings or seal rings. Further, in some embodiments, the sealing member is positioned between the internal surface of the pump seating nipple and the external surface of the downhole pump when the downhole pump is received within the bore of the pump seating nipple.

In each of the system and the pump seating nipple, the axial force anchor device may include any axial anchoring or holddown elements, members or components and have any configuration capable of, and suitable for, providing resistance to axial or longitudinal movement of the downhole pump relative to the pump seating nipple. In some embodiments, the axial force anchor device includes a friction member associated with one of the pump seating nipple and the downhole pump and a complementary friction surface associated with the other of the pump seating nipple and the downhole pump.

Thus, in some embodiments, the axial force anchor device includes a friction member and a complementary friction surface, wherein the nipple axial force anchoring component includes either the friction member or the friction surface. Thus, the pump axial force anchoring component includes the other of the friction member and the friction surface. Preferably, the nipple axial force anchoring component includes the friction surface. Further, the friction surface is preferably associated with the internal surface of the pump seating nipple. Accordingly, the pump axial force anchoring component includes the friction member. Thus, the friction member is associated with the downhole pump, preferably the external surface of the downhole pump.

The friction member may include one or a plurality of friction rings, friction mechanisms or frictional devices capable of resisting axial movement of the downhole pump relative to the pump seating nipple. For instance, the friction member may include one or more friction rings. Further, in some embodiments, the friction member is positioned between the internal surface of the pump seating nipple and the external surface of the downhole pump when the downhole pump is received within the bore of the pump seating nipple.

The seal device and the axial force anchor device may be provided as an integral unit or component of the system and the pump seating nipple. Alternately, the seal device and the axial force anchor device may be provided as separate components or units which are mounted, fastened or otherwise connected together to form the system and the pump seating nipple.

Thus, the surfaces or members including each of the nipple sealing component and the nipple axial force anchoring component may be integrally formed as a single surface or member providing the function of both components. Alternately, each of the nipple sealing component and the nipple axial force anchoring component may include one or more surfaces or members which are attached, fastened, connected or otherwise associated with each other to provide the pump seating nipple.

In some embodiments, the axial force anchor device and the seal device include a combined seal and axial force anchor device. The devices may be combined in any manner permitting the combined device to perform both the sealing and axial movement restraining functions. For instance, the nipple sealing component and the nipple axial force anchoring component may include a combined seal and axial force anchoring surface.

Preferably, the seal surface and the friction surface are associated with the internal surface of the pump seating nipple. Thus, the combined seal and axial force anchoring surface is preferably associated with the internal surface of the pump seating nipple. As a result, the seal member and the friction member are associated with the downhole pump, preferably with the external surface of the downhole pump.

In each of the system and the pump seating nipple, the rotational force anchor device may include any rotational anchoring or holddown components and have any configuration capable of, and suitable for, providing resistance to rotational movement of the rotary downhole pump relative to the pump seating nipple. In some embodiments, the rotational force anchor device includes a latch member and a complementary latch slot for engaging the latch member, wherein the latch member and the latch slot are configured so that rotational movement of the downhole pump relative to the pump seating nipple is resisted when the latch member is engaged with the latch slot, and wherein the nipple rotational force anchoring component includes either the latch member or the latch slot. Thus, the pump rotational force anchoring component includes the other of the latch member and the latch slot. In a preferred embodiment, the nipple rotational force anchoring component includes the latch slot. Accordingly, the pump rotational force anchoring component includes the latch member.

The rotational force anchor device may be provided with one or both of the seal device and the axial force anchor device as an integral unit or component of the system and the pump seating nipple. Alternately, the rotational force anchor device may be provided as separate component or unit which is mounted, fastened or otherwise connected together with one or both of the seal device and the axial force anchor device to form the system and the pump seating nipple.

In some embodiments, the rotational force anchor device and the axial force anchor device include a combined rotational and axial force anchor device. The devices may be combined in any manner permitting the combined device to perform both the rotational and axial movement restraining functions. For instance, the combined rotational and axial force anchor device may include a latch member and a complementary latch slot for engaging the latch member, wherein the latch member and the latch slot are configured so that both rotational movement and axial movement of the downhole pump relative to the pump seating nipple are resisted when the latch member is engaged with the latch slot.

In some embodiments, a system for connecting a rotary downhole pump with a pump seating nipple includes a rotational force anchor device for resisting rotational movement of the downhole pump relative to the pump seating nipple, the rotational force anchor device including:

(a) a latch slot associated with one of the pump seating nipple and the downhole pump; and (b) a latch member associated with the other of the pump seating nipple and the downhole pump, for engaging the latch slot;

wherein the latch slot and the latch member are complementary and are configured so that rotational movement of the downhole pump relative to the pump seating nipple is resisted when the latch member is engaged with the latch slot.

As discussed above, the pump seating nipple has a proximal end, a distal end, and an internal surface defining a bore extending between the proximal end and the distal end for receiving the downhole pump and the downhole pump has an external surface. The latch slot is preferably associated with one of the internal surface of the pump seating nipple and the external surface of the downhole pump, and wherein the latch member is positioned between the internal surface of the seating nipple and the external surface of the downhole pump when the downhole pump is received within the bore of the pump seating nipple.

As indicated, in some embodiments, the rotational force anchor device includes at least one latch slot and at least one latch member. However, the rotational force anchor device may include a plurality of latch members and a plurality of complementary latch slots.

Preferably, the latch slot, or each latch slot, is associated with the pump seating nipple and the latch member, or each latch member, is associated with the downhole pump. More particularly, as discussed above, each latch slot is preferably defined by the internal surface of the pump seating nipple. The plurality of latch slots may be arranged in any configuration suitable for engagement with the latch members. However, in some embodiments, the plurality of latch slots are spaced circumferentially around the internal surface of the pump seating nipple.

The latch slot, or each of the latch slots in the instance of a plurality of latch slots, is defined by a proximal wall, a distal wall and two sidewalls. Preferably, each latch slot is defined by a proximal wall, a distal wall and two sidewalls in the internal surface of the pump seating nipple. Further, at least one of the sidewalls provides a latch slot torque bearing surface. The latch slot torque bearing surface is preferably provided for engagement with a complementary latch member torque bearing surface on the latch member, or one of the plurality of latch members, in order to resist rotational movement of the downhole pump relative to the pump seating nipple. For instance, the latch member, or each latch member in the instance of a plurality of latch members, may have a proximal end, a distal end and two side edges. At least one of the side edges provides a latch member torque bearing surface which is complementary to the latch slot torque bearing surface.

Preferably, both of the sidewalls of the latch slot, or each latch slot, provide latch slot torque bearing surfaces. The latch slot torque bearing surfaces are provided for engagement with the complementary latch member torque bearing surfaces on the latch member, or each latch member, in order to resist rotational movement of the downhole pump relative to the pump seating nipple. For instance, both of the side edges of the latch member, or each latch member, may provide latch member torque bearing surfaces which are complementary to the latch slot torque bearing surfaces.

In addition, the rotational force anchor device may further include a resilient arm attached to the latch member for connecting the latch member with the downhole pump and wherein the latch member is biased toward the latch slot by the resilient arm when the downhole pump is received within the bore of the pump seating nipple so that the latch member is urged into engagement with the latch slot when the latch member is adjacent to the latch slot. Where a plurality of latch slots and a plurality of complementary latch members are provided, a plurality of resilient arms are also provided for connecting the latch members with the downhole pump.

In some embodiments, the latch member, or each of the latch members, is connected with the downhole pump such that the latch member and the resilient arm are positioned between the internal surface of the pump seating nipple and the external surface of the downhole pump and the resilient arm is deflected by the pump seating nipple when the downhole pump is received within the bore of the pump seating nipple, thereby biasing the latch member toward the latch slot.

Further, the downhole pump preferably defines a latch cavity for the latch member and the resilient arm and wherein the latch member and the resilient arm are receivable in the latch cavity to accommodate the deflection of the resilient arm. In the case of a plurality of latch members and resilient arms, the downhole pump defines a plurality of latch cavities for the latch members and the resilient arms and wherein the latch members and the resilient arms are receivable in the latch cavities to accommodate the deflection of the resilient arms.

Preferably, the latch cavity, or each of the latch cavities, is defined by two latch cavity sidewalls, wherein at least one of the latch cavity sidewalls provides a latch cavity torque bearing surface. Further, the resilient arm has two resilient arm side edges, wherein at least one of the resilient arm side edges provides a resilient arm torque bearing surface which is complementary to the latch cavity torque bearing surface, so that the latch cavity supports the resilient arm in order to resist rotation of the downhole pump relative to the pump seating nipple when the latch member is engaged with the latch slot. In some embodiments, both of the latch cavity sidewalls provide a latch cavity torque bearing surface and both of the resilient arm side edges provide a complementary resilient arm torque bearing surface.

Thus, when the rotary downhole pump is received within the bore of the pump seating nipple, the latch members are engaged with the latch slots to resist rotational movement of the downhole pump relative to the pump seating nipple. Further, where the system further includes the seal device, the sealing member is axially aligned with the sealing surface when the latch members are engaged with the latch slots. In addition, where the system further includes the axial force anchor device, the friction member is aligned with the friction surface when the latch members are engaged with the latch slots.

Each of the latch members and the resilient arms may be mounted, fastened or otherwise associated with the downhole pump in any manner and by any mechanism permitting the functioning of the latch members and the resilient arms in the above described manner. In some embodiments, the rotational force anchor device further includes a collet surrounding the downhole pump and wherein the collet includes the latch members and the resilient arms.

The collet may be mounted, fastened or otherwise associated, either permanently or detachably, with the downhole pump in any manner and by any mechanism capable of providing the necessary connection between the collet and the downhole pump. In some embodiments, the rotational force anchor device further includes a collet retainer for retaining the collet on the downhole pump.

The collet retainer is mounted, fastened or otherwise associated, either permanently or detachably, with the downhole pump in any manner capable of providing the connection between the collet retainer and the downhole pump. For instance, the collet retainer may be welded or fixedly attached to the downhole pump. Alternately, the collet retainer may be threadably connected with the downhole pump.

BRIEF DESCRIPTION OF THE DRAWINGS

For a more detailed understanding of the present disclosure, reference is made to the accompanying figures, wherein.

Embodiments of the invention will now be described with reference to the accompanying drawings, in which.

DETAILED DESCRIPTION OF THE DISCLOSED EMBODIMENTS

Figure 1:
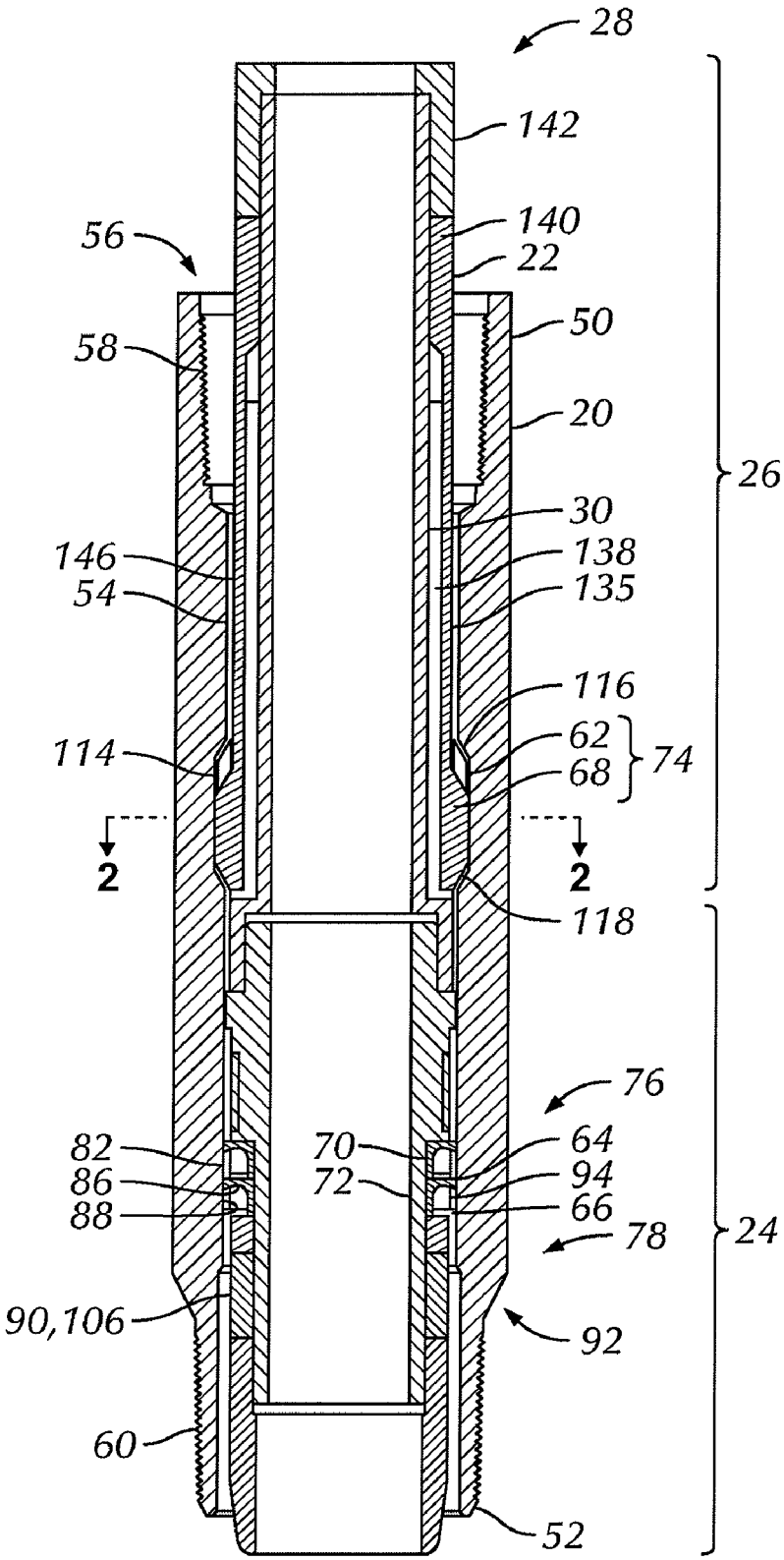
FIG. 1 is longitudinal section of a pump seating nipple engaged with a downhole pump in a set position in accordance with the principles disclosed herein.

Referring to FIGS. 1-5, a pump seating nipple (20) is provided for engagement with a downhole pump (22), being either a reciprocating pump or a rotary pump. The specific configuration of the downhole pump (22) is variable depending upon whether the downhole pump (22) to be engaged with the pump seating nipple (20) is a reciprocating pump or a rotary pump. In particular, as shown in FIG. 1, the downhole pump (20) includes a reciprocating portion (24) and a rotary portion (26). Further, the pump seating nipple (20) and the downhole pump (22) may be assembled to provide either a top hold down configuration or a bottom holddown configuration of the downhole pump (22). Preferably, a bottom hold down configuration is provided.

With respect to a reciprocating downhole pump, the downhole pump (22) includes the reciprocating portion (24), while the rotary portion (26) is optional. Preferably, the rotary portion (26) is not included in the reciprocating downhole pump. With respect to a rotary downhole pump, the downhole pump (22) includes the rotary portion (26), while the reciprocating portion (24) is optional. Preferably, the reciprocating portion (24) is included in the rotary downhole pump. Further, referring to FIG. 1, a system (28) is provided for connecting the rotary downhole pump (22) with the pump seating nipple (20).

Figure 3:
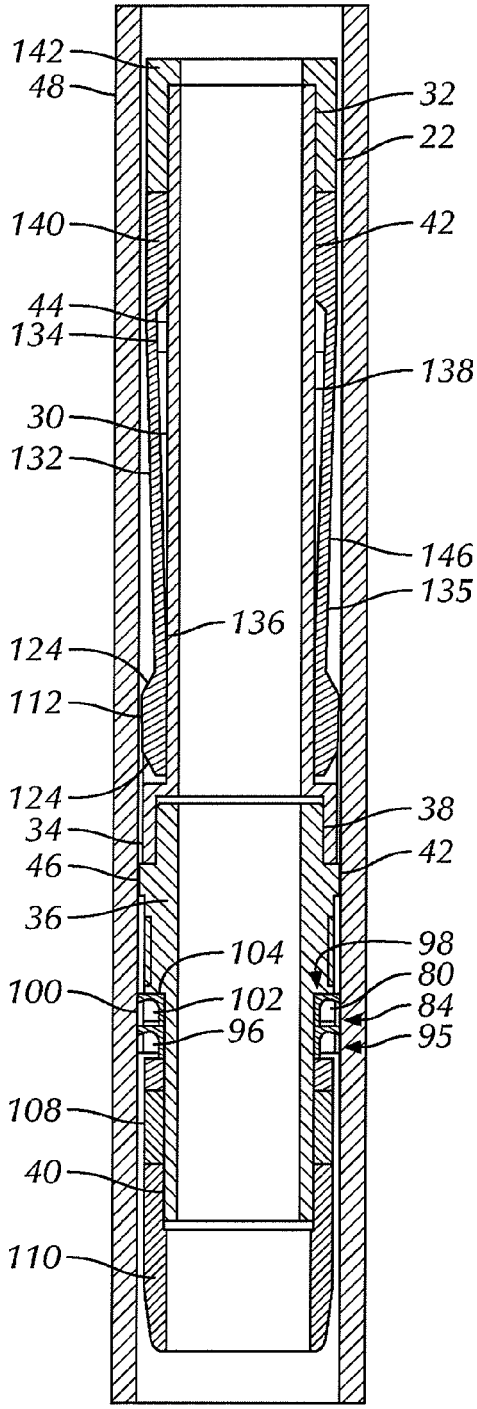
FIG. 3 is a longitudinal section of the downhole pump of FIG. 1 in a running position within a production tubing.

As shown in FIGS. 1 and 3, the rotary portion (26) of the downhole pump (22) includes an upper mandrel (30) extending from a proximal end (32) to a distal end (34). Preferably, the upper mandrel (30) includes a single or unitary member extending between the proximal and distal ends (32, 34). However, alternately, the upper mandrel (30) may include a plurality of members attached or connected together, either permanently or detachably, to form the upper mandrel (30).

The proximal end (32) of the upper mandrel (30) is configured or adapted for connection with further uphole components of the downhole pump (20) or a bottomhole assembly, with a production or drilling string or coiled tubing or with other downhole equipment for extending from the downhole pump (22) towards or to the surface. For instance, the proximal end (32) of the upper mandrel (30) may provide a threaded connection. The distal end (34) of the upper mandrel (30) is configured or adapted for connection, either directly or indirectly, with the reciprocating portion (24) of the downhole pump (22) as described below.

The reciprocating portion (24) of the downhole pump (22) includes a lower mandrel (36) extending from a proximal end (38) to a distal end (40). Preferably, the lower mandrel (36) includes a single or unitary member extending between the proximal and distal ends (38, 40). However, alternately, the lower mandrel (36) may include a plurality of members attached or connected together, either permanently or detachably, to form the lower mandrel (36).

The proximal end (38) of the lower mandrel (36) is configured or adapted for connection, either directly or indirectly, with the rotary portion (26) of the downhole pump (22). Preferably, the rotary and reciprocating portions (26, 24) are directly connected. However, the downhole pump (22) may include one or more further components or members which are positioned between the rotary and reciprocating portions (26, 24) of the downhole pump (22).

Preferably, the proximal end (38) of the lower mandrel (36) is configured or adapted for connection or attachment, either permanently or detachably, with the distal end (34) of the upper mandrel (30). For instance, as shown in FIGS. 1 and 3, the proximal end (38) of the lower mandrel (36) may be threadably connected with the distal end (34) of the upper mandrel (30).

The distal end (40) of die lower mandrel (36) is configured or adapted for connection with further downhole components of the downhole pump (20) or a bottomhole assembly for extending further downhole or into the borehole away from the surface. For instance, the distal end (40) of the lower mandrel (36) may provide a threaded connection.

Further, the downhole pump (22) has an external surface (42). The external surface (42) of the downhole pump (22) is defined, at least in part, by an external surface (44) of the upper mandrel (30) and an external surface (46) of the lower mandrel (36).

As described above, and as shown in FIGS. 1 and 3, the downhole pump (22) is preferably configured such that when the downhole pump (22) is run or placed downhole in the borehole, the rotary portion (26) is arranged nearer or in closer proximity to the surface than the reciprocating portion (24). However, the downhole pump (22) may be configured, if desired, such that when the downhole pump (22) is ran or placed downhole in the borehole, the reciprocating portion (24) is arranged nearer or in closer proximity to the surface than the rotary portion (26). For instance, the arrangement of the upper and lower mandrels (30, 36) may be reversed.

The pump seating nipple (20) is configured for receiving the downhole pump (20) in order to anchor the downhole pump (22) relative to the pump seating nipple (20). In addition, the pump seating nipple (20) is also preferably configured for receiving the downhole pump (22) in order to seal the downhole pump (22) relative to the pump seating nipple (20).

With respect to the anchor function, the pump seating nipple (20) may be configured or adapted to be compatible for use with either or both of a rotary downhole pump and a reciprocating downhole pump. More particularly, as shown in one embodiment in FIG. 1, the pump seating nipple (20) is configured or adapted to receive or accommodate the rotary portion (26) of the downhole pump (22). Preferably, the pump seating nipple (20) is further configured or adapted to receive or accommodate the reciprocating portion (24) of the downhole pump (22). Thus, the pump seating nipple (20) is capable of interchangeably receiving or accommodating both a reciprocating pump and a rotary pump as required for operation downhole.

When the reciprocating portion (24) of the downhole pump (22) is engaged with the pump seating nipple (20), the pump seating nipple (20) acts to resist or restrain axial movement of the downhole pump (22) relative to the pump seating nipple (20). When the rotary portion (26) of the downhole pump (22) is engaged with the pump seating nipple (20), the pump seating nipple (20) acts to resist or restrain rotational movement of the downhole pump (22) relative to the pump seating nipple (20).

The pump seating nipple (20) is adapted for connection into a production tubing or a tubing string (48), such as that shown in FIG. 3, for placement with the tubing string (48) downhole in the borehole or wellbore. As shown in FIG. 3, the downhole pump (22) is then run through the tubing string (48) from the surface for engagement with the pump seating nipple (20). Accordingly, the downhole pump (22) may be engaged with or removed from the pump seating nipple (20) as required. The downhole pump (22) is shown in a running position within the tubing string (48) in FIG. 3. The downhole pump (22) is shown in a set position engaged with the pump seating nipple (20) in FIG. 1.

Figure 2:
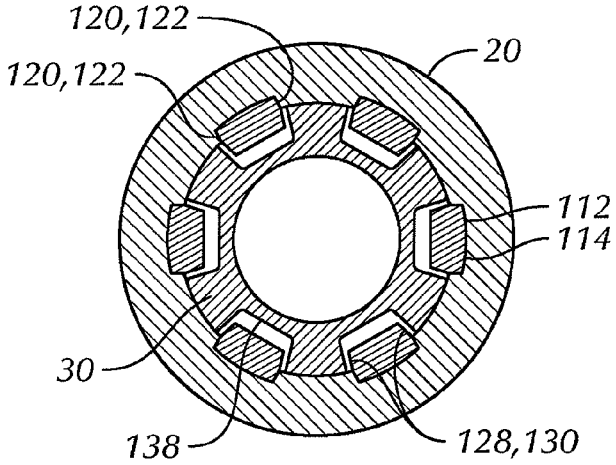
FIG. 2 is a cross-sectional view of the pump seating nipple and downhole pump taken along lines 2-2 of FIG. 1.

Referring to FIGS. 1 and 2, the pump seating nipple (20) has a proximal end (50), all opposed distal end (52), and an internal surface (54) defining a bore (56) extending between the proximal and distal ends (50, 52). The bore (56) is sized and configured for receiving the downhole pump (22) therein such that the downhole pump (22) is engaged with the pump seating nipple (20) in the manner described herein.

Preferably, the pump seating nipple (20) includes a single or unitary member, such as a tubular member, extending between the proximal and distal ends (50, 52). However, alternately, the pump seating nipple (20) may include a plurality of members attached or connected together, either permanently or detachably, to form the pump seating nipple (20).

As discussed above, the proximal end (50) of the pump seating nipple (20) is configured or adapted for connection, either directly or indirectly, with an uphole portion of the tubing string (48) or additional downhole equipment for extending to the surface. For instance, the proximal end (50) of the pump seating nipple (20) may provide a threaded surface (58) for threadably connecting with the tubing string (48).

The distal end (52) of the pump seating nipple (20) is preferably configured or adapted for connection, either directly or indirectly, with a downhole portion of the tubing string (48) or additional downhole equipment for extending further downhole or into the borehole away from the surface. For instance, the distal end (52) of the pump seating nipple (20) may provide a threaded surface (60) for threadably connecting with the tubing string (48).

In some embodiments, the tubing string (48) includes a latch mechanism (not shown) positioned in the tubing string (48) downhole of the pump seating nipple (20). Any latch mechanism or latching device may be utilized which is compatible with the downhole pump (22) for either inhibiting or preventing the passage of the downhole pump (22) therethrough. Thus, the latch mechanism or latching device is provided to assist with or facilitate the placement of the downhole pump (22) in the pump seating nipple (20).

For instance, engagement of the downhole pump (22) with the latch mechanism or latching device provides an indication that the downhole pump (22) has bypassed or passed through the pump seating nipple (20) and has not been properly engaged with the pump seating nipple (20). Further, the latch mechanism or latching device may be positioned so that the downhole pump (22) engages the latch mechanism or latching device concurrently with the proper placement of the downhole pump (22) relative to the pump seating nipple (20).

The pump seating nipple (20) includes a nipple rotational force anchoring component (62). In addition, the pump seating nipple (20) preferably includes a nipple axial force anchoring component (64). Finally, the pump seating nipple (20) may also include a nipple sealing component (66). In some embodiments, the internal surface (54) of the pump seating nipple (20) defines or is associated with each of the nipple rotational force anchoring component (62), the nipple axial force anchoring component (64) and the nipple sealing component (66).

Complementary structure is preferably provided by the downhole pump (22) for cooperating with each of the nipple rotational force anchoring component (62), the nipple axial force anchoring component (64) and the nipple sealing component (66). Thus, the downhole pump (22) includes a pump rotational force anchoring component (68) complementary with the nipple rotational force anchoring component (62). In addition, the downhole pump (22) may include a pump axial force anchoring component (70) complementary with the nipple axial force anchoring component (64). Finally, the downhole pump (22) may also include a pump sealing component (72) complementary with the nipple sealing component (66).

In some embodiments, the downhole pump (22), and preferably the external surface (42) thereof, defines or is associated with one or each of the pump rotational force anchoring component (68), the pump axial force anchoring component (70) and the pump sealing component (72). In these embodiments, as shown in FIGS. 1-3, the rotary portion (26) of the downhole pump (22), and particularly the external surface (44) of the upper mandrel (30), defines or is associated with the pump rotational force anchoring component (68). The reciprocating portion (24) of the downhole pump (22), and particularly the external surface (46) of the lower mandrel (36), defines or is associated with the pump axial force anchoring component (70) and the pump sealing component (72).

Referring to FIGS. 1 and 2, the nipple rotational force anchoring component (62) cooperates or engages with the pump rotational force anchoring component (68) in order to provide a rotational force anchor device (74) for resisting rotational movement of the downhole pump (22) relative to the pump seating nipple (20). The nipple axial force anchoring component (64) cooperates or engages with the pump axial force anchoring component (70) in order to provide an axial force anchor device (76) for resisting axial movement of the downhole pump (22) relative to the pump seating nipple (20). The nipple sealing component (66) cooperates or engages with the pump sealing component (72) in order to provide a seal device (78) for sealing between the downhole pump (22) and the pump seating nipple (20).

System (28) includes the rotational force anchor device (74) for resisting rotational movement of a rotary downhole pump (22) relative to the pump seating nipple (20). The system may also include one or both of the axial force anchor device (76) and the seal device (78). The pump seating nipple (20) preferably includes the nipple sealing component (66), the nipple axial force anchoring component (64) and the nipple rotational force anchoring component (62) in order to be able to interchangeably seal with and anchor either a reciprocating or rotary downhole pump (22).

As shown in FIGS. 1-3, the seal device (78) preferably includes a sealing member (80) and a complementary sealing surface (82). In some embodiments, the nipple sealing component (66) includes the sealing surface (82). More particularly, the sealing surface (82) is preferably provided or defined by a portion of the internal surface (54) of the pump seating nipple (20), which is configured or dimensioned for sealing engagement with the sealing member (80). The pump sealing component (72) includes the sealing member (80). More particularly, the sealing member (80) is preferably provided by or associated with the downhole pump (22), preferably the external surface (42) of the downhole pump (22). As shown in FIGS. 1 and 3, the sealing member (80) is associated with the external surface (46) of the lower mandrel (36) of the downhole pump (22) for sealing with the adjacent sealing surface (82) of the pump seating nipple (20).

In a preferred embodiment of the seal device (78), the sealing member (80) is positioned between the internal surface (54) of the pump seating nipple (20) and the external surface (46) of the lower mandrel (36) of the downhole pump (22) when the downhole pump (22) is received within the bore (56) of the pump seating nipple (20). Further, the sealing member (80) preferably includes one or more seal rings (84).

As shown in FIGS. 1-3, the axial force anchor device (76) preferably includes a friction member (86) and a complementary friction surface (88). In some embodiments, the nipple axial force anchoring component (64) includes the friction surface (88). More particularly, the friction surface (88) is preferably provided or defined by a portion of the internal surface (54) of the pump seating nipple (20), which is configured or dimensioned for frictional engagement with the friction member (86). The pump axial force anchoring component (70) includes the friction member (86). More particularly, the friction member (86) is preferably provided by or associated with the downhole pump (22), preferably the external surface (42) of the downhole pump (22). As shown in FIGS. 1 and 3, the friction member (86) is associated with the external surface (46) of the lower mandrel (36) of the downhole pump (22) for engaging or contacting the adjacent friction surface (88) of the pump seating nipple (20).

In a preferred embodiment of the axial force anchor device (76), the friction member (86) is positioned between the internal surface (54) of the pump seating nipple (20) and the external surface (46) of the lower mandrel (36) of the downhole pump (22) when the downhole pump (22) is received within the bore (56) of the pump seating nipple (20). Further, the friction member (86) preferably includes at least one function ring (90).

Thus, as shown in FIGS. 1 and 3, in some embodiments, the seal device (78) and the axial force anchor device (76) are provided as a combined seal and axial force anchor device (92). More particularly, the sealing surface (82) and the friction surface (88) include a combined seal and axial force anchoring surface (94). The combined seal and axial force anchoring surface (94) is provided or defined by a portion of the internal surface (54) of the pump seating nipple (20).

Similarly, the sealing member (80) and the friction member (86) may include separate structural components, or may include at least one combined seal and axial force anchoring member (95) positioned between the combined seal and axial force anchoring surface (94) and the external surface (46) of the lower mandrel (36) of the downhole pump (22) when the downhole pump (22) is received within the bore (56) of the pump seating nipple (20). The combined seal and axial force anchor device (92) may be of the type described in Canadian Patent No. 1,324,167 issued on Nov. 9, 1993 to Hermanson.

Referring to FIGS. 1 and 3, the combined seal and axial force anchoring member (95) preferably includes one or more friction seal rings (96), preferably metal function seal rings as described in detail in Canadian Patent No. 1,324,167 issued on Nov. 9, 1993 to Hermanson. Thus, the lower mandrel (36) is shaped to provide a recess or define a space to accommodate the function seal rings (96) and to define a shoulder (98) for engaging the uppermost friction seal ring (96) contained within the recess. Each friction seal ring (96) includes a resilient leg (100), a relatively rigid leg (102) and a connecting leg (104) therebetween. The resilient leg (100) is adapted for contacting the combined seal and axial force anchoring surface (94), the rigid leg (102) is adapted for contacting the external surface (46) of the lower mandrel (36) and the connecting leg (104) is adapted to fit and seal against the mandrel shoulder (98) or a lowermost surface of an adjacent friction seal ring (96).

Thus, the friction seal rings (96) combine the functions of the sealing member (80) and the friction member (86). In particular, the friction seal rings (96) contact the combined seal and axial force anchoring surface (94) in a manner to provide a sealing force therebetween and to provide an axial anchoring force for resisting axial movement of the downhole pump (22) relative to the pump seating nipple (20).

Further, the combined seal and axial force anchoring member (95) may further include one or more friction rings (90) adapted for contacting the combined seal and axial force anchoring surface (94). As well, the combined seal and axial force anchoring member (95) may include one or more spacer rings (106), being an L-shaped member, for holding the friction rings (90) in a desired position to provide an axial anchoring force for further resisting axial movement of the downhole pump (22) relative to the pump seating nipple (20).

The combined seal and axial force anchoring member (95) may be maintained in the desired position relative to the lower mandrel (36) by any suitable retaining mechanism or device.

For instance, as shown in FIGS. 1 and 3, a nut (108) may be threadably engaged with the external surface (46) of the lower mandrel (36) adjacent to the combined seal and axial force anchoring member (95) such that the combined seal and axial force anchoring member (95) is held or maintained between the mandrel shoulder (98) and the nut (108). Further, as shown in the Figures, if desired, a bushing (110) may also be threadably engaged with the external surface (46) of the lower mandrel (36) adjacent to the nut (108).

Referring to FIGS. 1-3, the rotational force anchor device (74) preferably includes a latch member (112) and a complementary latch slot (114) for engaging the latch member (112). The latch member (112) and the latch slot (114) are configured so that rotational movement of the downhole pump (22) relative to the pump seating nipple (20) is resisted when the latch member (112) is engaged with the latch slot (114). In some embodiments, the nipple rotational force anchoring component (62) includes the latch slot (114). More particularly, the latch slot (114) is preferably provided or defined by a portion of the internal surface (54) of the pump seating nipple (20). The pump rotational force anchoring component (68) includes the latch member (112). More particularly, the latch member (112) preferably includes or is associated with the downhole pump (22), preferably the external surface (42) of the downhole pump (22).

As shown in FIGS. 1 and 3, the latch member (112) is associated with the external surface (44) of the upper mandrel (30) of the downhole pump (22) for engagement or reception in the adjacent latch slot (114) on the pump seating nipple (20). More particularly, in some embodiments of the rotational force anchor device (74), the latch member (112) is positioned between the internal surface (54) of the pump seating nipple (20) and the external surface (44) of the upper mandrel (30) of the downhole pump (22) when the downhole pump (22) is received within the bore (56) of the pump seating nipple (20).

As described further below, the latch member (112) and the latch slot (114) are configured so that rotational movement of the downhole pump (22) relative to the pump seating nipple (20) is resisted when the latch member (112) is engaged with the latch slot (114). If desired, the latch member (112) and the latch slot (114) may be further configured so that axial movement of the downhole pump (22) relative to the pump seating nipple (20) is also resisted when the latch member (112) is engaged with the latch slot (114). In this case, the complementary latch slot (114) and latch member (112) may include both the rotational force anchor device (74) and the axial force anchor device (76).

In addition, the rotational force anchor device (74) may include a single latch member (112) for receipt in a single complementary latch slot (114). However, preferably, as shown in FIG. 2, the rotational force anchor device (74) includes a plurality of latch members (112) and a plurality of complementary latch slots (114) arranged in a suitable configuration to provide the desired or required resistance to rotational movement. For instance, as shown in FIG. 2, the plurality of latch slots (114) are spaced circumferentially around the internal surface (54) of the pump seating nipple (20). Similarly, the complementary latch members (112) are spaced circumferentially in the same manner or configuration about the external surface (42) of the downhole pump (22).

As shown in FIGS. 1 and 2, in one configuration, each of the latch slots (114) is defined by a proximal wall (116), a distal wall (118) and two opposed sidewalls (120). The distance between the proximal and distal walls (116, 118) defines a length of the latch slot (114), while the distance between the sidewalls (120) defines a width of the latch slot (114). Similarly, each of the latch members (112) includes a proximal end (124), a distal end (126) and two opposed side edges (128). The distance between the proximal and distal ends (124, 126) defines a length of the latch member (112), while the distance between the side edges (128) defines a width of the latch member (112). The latch slot (114) has a size and configuration to accommodate the receipt or engagement of the latch member (112) therein. Preferably, the latch slots (114) are machined in the internal surface (54) of the pump seating nipple (20) utilizing Electrical Discharge Machining (EDM) which pen-nits a relatively precise dimensioning of the latch slot (114).

More particularly, the width of the latch slot (114) is preferably selected such that the side edges (128) of the latch member (112) are relatively closely received within the sidewalls (120) when the latch member (112) is received within the latch slot (114). As a result, limited rotational movement of the latch member (112) within the latch slot (114) is permitted. The length of the latch slot (114) may also be selected such that the proximal and distal ends (124, 126) of the latch member (112) are relatively closely received therein when the latch member (112) is received within the latch slot (114). However, in order to facilitate the placement of the latch member (112) within the latch slot (114), the length of the latch slot (114) is preferably greater than the length of the latch member (112).

Further, at least one of the sidewalls (120) is shaped or configured to provide a latch slot torque bearing surface (122). Similarly, at least one of the side edges (128) is shaped or configured to provide a latch member torque bearing surface (130) which is complementary to the latch slot torque bearing surface (122).

In particular, rotation of the downhole pump (22) in a first rotary direction relative to the pump seating nipple (20) is inhibited or prevented by the abutment or engagement of the latch slot torque bearing surface (122) and the latch member torque bearing surface (130). In other words, the latch slot torque bearing surface (122) engages the complementary latch member torque bearing surface (130) in order to resist rotational movement of the downhole pump (22) relative to the pump seating nipple (20). In order to resist or prevent relative rotational movement, each of the latch member torque bearing surface (130) and the latch slot torque bearing surface (122) have a complementary or corresponding shape such that the surfaces (130, 122) abut and are inhibited or prevented from sliding or moving past each other, as shown in FIG. 2.

If desired, rotation of the downhole pump (22) in both a first rotary direction and an opposed second rotary direction relative to the pump seating nipple (20) may be inhibited or prevented. Specifically, both of the sidewalls (120) of the latch slot (114) may provide latch slot torque bearing surfaces (122). Similarly, both of the side edges (128) of the latch member (112) may provide latch member torque bearing surfaces (130) complementary to the latch slot torque bearing surfaces (122).

As indicated above, if desired, the latch slot (114) and the latch member (112) may also be configured to inhibit or prevent axial movement of the downhole pump (22) relative to the pump seating nipple (20) in either or both of a first axial direction and a second axial direction when the latch member (112) is engaged in the latch slot (114).

For instance, one or both of the proximal wall (116) and the distal wall (118) of the latch slot (114) may be shaped or configured to provide a latch slot axial force bearing surface. Similarly, one or both of the proximal end (124) and the distal end (126) of the latch member (112) may be shaped or configured to provide a latch member axial force bearing surface which is complementary to the respective latch slot axial force bearing surface.

Thus, axial movement of the downhole pump (22) in a first axial direction relative to the pump seating nipple (20) may be inhibited or prevented by the abutment or engagement of the latch slot axial force bearing surface provided by the proximal wall (116) and the latch member axial force bearing surface provided by the proximal end (124). Conversely, axial movement of the downhole pump (22) in a second opposed axial direction relative to the pump seating nipple (20) may be inhibited or prevented by the abutment or engagement of the latch slot axial force bearing surface provided by the distal wall (118) and the latch member axial force bearing surface provided by the distal end (126).

However, as shown in FIG. 1, in a preferred embodiment, axial movement of the downhole pump (22) relative to the pump seating nipple (20) is not prevented in either the first or the second axial direction in order to readily permit or facilitate the engagement and disengagement of the downhole pump (22) with the pump seating nipple (20). Accordingly, each of the proximal wall (146) and the distal wall (118) of the latch slot (114) is preferably sloped or tapered for engagement with a corresponding sloped or tapered proximal end (124) and distal end (126) respectively of the latch member (112). Thus, when the latch member (112) is received in the latch slot (114), an axial force or tension may be applied to the downhole pump (22) in order to disengage the downhole pump (22) from the pump seating nipple (20).

In order to further facilitate the setting and disengagement of the downhole pump (22) with the pump seating nipple (20), the rotational force anchor device (74) preferably further includes a resilient arm (132) attached to each of the latch members (112) for connecting the latch member (112) with the downhole pump (22), and particularly with the external surface (44) of the upper mandrel (30). Each latch member (112) is biased toward the latch slot (114) by the resilient arm (132) when the downhole pump (22) is received within the bore (56) of the pump seating nipple (20) so that the latch member (112) is urged into engagement with the latch slot (114) when the latch member (112) is adjacent to the corresponding latch slot (114).

In some embodiments, each of the latch members (112) is connected with the external surface (42) of the downhole pump (22) such that the latch member (112) and the resilient arm (132) are positioned between the internal surface (54) of the pump seating nipple (20) and the external surface (44) of the upper mandrel (30). When the downhole pump (22) is received within the bore (56) of the pump seating nipple (20), the resilient arm (132) is deflected by the pump seating nipple (20), thereby biasing the latch member (112) toward the latch slot (114). When the latch member (112) is moved adjacent to the corresponding latch slot (114), the biasing of the latch member (112) causes the latch member (112) to be urged into engagement with the latch slot (114).

As shown in FIGS. 1 and 3, the resilient arm (132) preferably has a proximal end (134) for connecting with the upper mandrel (30), a distal end (136) for connecting with the latch member (112) and two side edges (135). The latch member (112) may be integrally formed with the distal end (136) of the resilient arm (132). Alternately, the latch member (112) may be connected, attached or otherwise fastened, either permanently or detachably, with the distal end (136) of the resilient arm (132) by any suitable fastener or connector.

Figure 4:
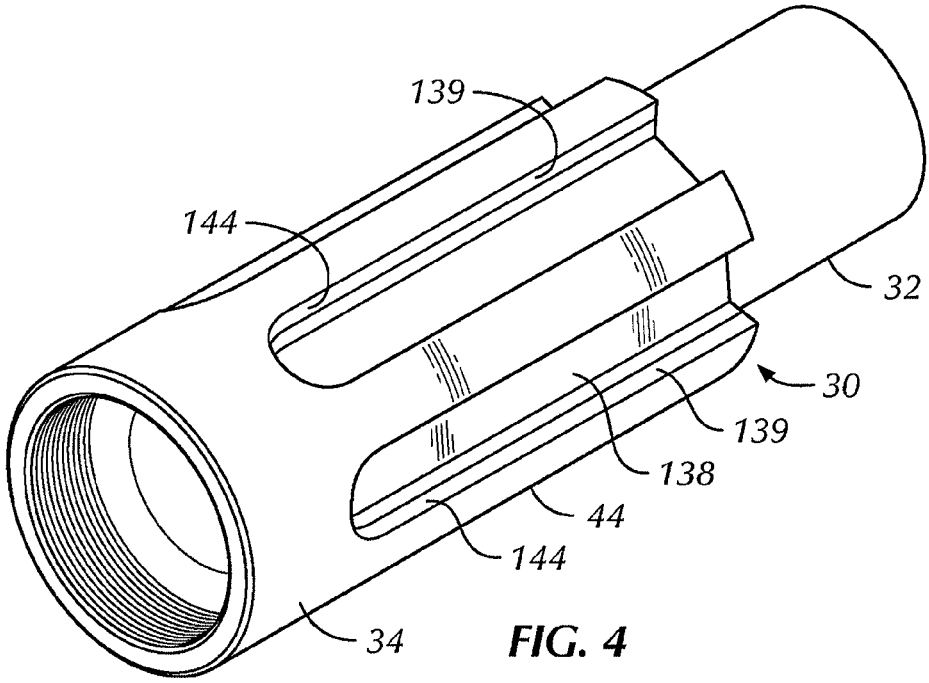
FIG. 4 is a perspective view of an upper mandrel of the downhole pump, in isolation.
Figure 5:
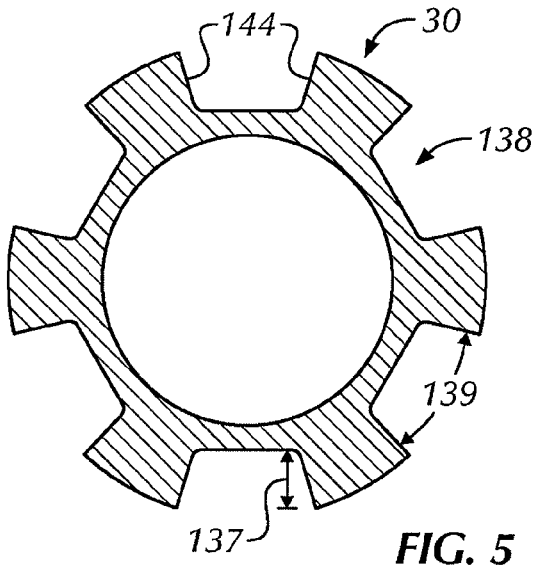
FIG. 5 is a cross-sectional view of the upper mandrel shown in FIG. 4.

Further, in some embodiments, the downhole pump (22) defines a latch cavity (138) configured for receiving a corresponding latch member (112) and resilient arm (132). More particularly, as shown in FIGS. 4 and 5, the latch cavities (138) are defined by the external surface (42) of the downhole pump (22), preferably the external surface (44) of the upper mandrel (30), to correspond with each of the latch members (112) and resilient arms (132). Accordingly, in some embodiments, the latch members (112) and their respective corresponding latch cavities (138) are spaced circumferentially about the external surface (42) of the downhole pump (22).

Preferably, each latch cavity (138) is configured and dimensioned to receive and support the resilient arm (132) and the latch member (112). In particular, the latch cavity (138) is dimensioned to provide a depth (137) sufficient to receive the resilient arm (132) and the latch member (112) in order to accommodate and facilitate the deflection of the resilient arm (132). Specifically, the latch member (112) and the resilient arm (132) are deflected into the corresponding latch cavity (138) when the downhole pump (22) is received within the bore (56) of the pump seating nipple (20).

Further, upon engagement of the latch member (112) in the latch slot (114), the latch cavity (138) is further configured and dimensioned to provide support to the latch member (112) and the resilient arm (132), particularly upon the application of torque to the downhole pump (22). In other words, upon the relative rotation of the downhole pump (22) and the pump seating nipple (20), the resilient arms (132) and the latch members (112) are supported, at least in part, by their engagement with the latch cavities (138).

More particularly, each of the latch cavities (138) is defined by opposed latch cavity sidewalls (139), which define a width of the latch cavity (138) therebetween. The latch cavity sidewalls (139) are provided for contacting and engaging the adjacent side edges (135) of the resilient arms (132). The sidewalls (139) of the latch cavity (138) may also contact and engage the side edges (128) of the latch members (112). Thus, each latch cavity (138), including the width of the latch cavity (138), is preferably configured and selected to closely receive the resilient arms (132) and the latch members (112) therein such that the sidewalls (139) of the latch cavity (138) provide support to and strengthen the corresponding resilient arm (132) and latch member (112) received therein.

More particularly, at least one of the latch cavity sidewalls (139) is preferably shaped or configured to provide a latch cavity torque bearing surface (144). Similarly, at least one of the resilient arm side edges (135) is preferably shaped or configured to provide a resilient arm torque bearing surface (146) which is complementary to the latch cavity torque bearing surface (144). Thus, the latch cavity (138) supports and strengthens the resilient arm (132) in order to further resist rotation of the downhole pump (22) relative to the pump seating nipple (20) when the latch member (122) is engaged with the latch slot (114).

In other words, upon rotation of the downhole pump (22) in a first rotary direction relative to the pump seating nipple (20), the resilient arm (132) is supported within the latch cavity (138) by the abutment or engagement of the resilient arm torque bearing surface (146) and the latch cavity torque bearing surface (144). Thus, the resilient arm torque bearing surface (146) engages the complementary latch cavity torque bearing surface (144) in order to further resist rotational movement of the downhole pump (22) relative to the pump seating nipple (20). In order to provide the desired support, each of the resilient arm torque bearing surface (146) and the latch cavity torque bearing surface (144) have a complementary or corresponding shape such that the surfaces (146, 133) abut and are inhibited or prevented from sliding or moving past each other.

As discussed above, if desired, rotation of the downhole pump (22) in both a first rotary direction and an opposed second rotary direction relative to the pump seating nipple (20) may be inhibited or prevented. In this instance, both of the sidewalls (139) of the latch cavity (138) may provide latch cavity torque bearing surfaces (144). Similarly, both of the side edges (135) of the resilient arm (132) may provide resilient arm torque bearing surfaces (146) complementary to the latch cavity torque bearing surfaces (144).

In order to mount or fasten the latch members (122) to the downhole pump (22), the proximal end (134) of each of the resilient arms (132) may be connected, attached or otherwise fastened, either permanently or detachably, with the upper mandrel (30) by any suitable fastener or connector. Alternately, the proximal end (134) of the resilient arm (132) may be integrally formed with the downhole pump (22). However, in some embodiments as shown in FIGS. 1 and 3, the rotational force anchor device (74) further includes a collet (140) surrounding the downhole pump (22). More particularly, the collet (140) may surround the external surface (44) of the upper mandrel (30).

The collet (140) includes the latch members (112) and the resilient arms (132). The collet (140) may include a plurality of members or components connected, attached or otherwise fastened together to provide the latch members (112) and the resilient arms (132). However, the collet (140) is preferably formed as an integral member or component providing the latch members (112) and the resilient arms (132). Accordingly, the upper mandrel (30) and the latch cavities (138) defined therein are provided to support and strengthen the collet (140).

The collet (140) may be detachably mounted with the external surface (42) of the downhole pump (22), such as by a threaded connection between an internal surface of the collet (140) and the external surface (44) of the upper mandrel (30). In some embodiments, the rotational force anchor device (74) further includes a collet retainer (142) for retaining the collet (140) in the desired position on the downhole pump (22).

Thus, for instance, the collet (140) may be positioned about the external surface (44) of the upper mandrel (30) and retained in that position by the collet retainer (142). In order to retain the position of the collet (140), the collet retainer (142) may be detachably mounted with the external surface (42) of the downhole pump (22), such as by a threaded connection between an internal surface of the collet retainer (142) and the external surface (44) of the upper mandrel (30).

Referring to FIG. 3, the tubing string (48) has a diameter. Further, the external surface (42) of the downhole pump (22) has a diameter or is dimensioned to permit its passage through the tubing string (48) for engagement with the pump seating nipple (20). Referring to FIG. 1, the bore (56) of the pump seating nipple (20) has a diameter or is dimensioned to permit the receipt of the downhole pump (22) therein and to engage with the components of the downhole pump (22) as described previously.

However, while still providing the necessary engagement between the downhole pump (22) and the pump seating nipple (20), the diameter of the pump seating nipple (20) is also preferably selected such that it is not substantially reduced from or smaller than the diameter of the tubing string (48) so that the presence of the pump seating nipple (20) in the tubing string (48) does not significantly interfere with the running of various equipment or tools downhole through the tubing string (48). More preferably, the pump seating nipple (20) provides a full standard API (American petroleum Institute) seating nipple internal diameter.

With respect to the setting of a rotary downhole pump (20) in the pump seating nipple (20), the downhole pump (22) preferably includes the reciprocating portion (24) having the axial force anchor device (76) and the seal device (78) and the rotary portion (26) having the rotational force anchor device (74).

Referring to FIG. 3, in order to set the rotary downhole pump (22) in the pump seating nipple (20), the downhole pump (22) is run or extended through the tubing string (48) from the surface to the pump seating nipple (20) downhole. As the downhole pump (22) is passing through the tubing string (48), the latch members (112) and the resilient arms (132) having the collet (140) are further deflected into or are receivable within the corresponding latch cavities (138), as shown in FIG. 3. As the downhole pump (22) is received within the bore (56) of the pump seating nipple (20), each resilient arm (132) continues to be deflected by the pump seating nipple (20), thereby biasing the latch member (112) toward the latch slot (114). When the latch member (112) is moved adjacent to a corresponding latch slot (114), the biasing of the latch member (112) causes the latch member (112) to be urged into engagement with the latch slot (114). In the event that the latch member (112) is not initially placed adjacent a corresponding latch slot (114), the downhole pump (22) may be rotated from the surface, or torque may be applied, to move the latch member (112) into alignment with the latch slot (114). The latch member (112) is then urged into engagement with the latch slot (114).

Thus, referring to FIGS. 1 and 2, when the rotary downhole pump (22) is received within the bore (56) of the pump seating nipple (20), the latch members (112) are engaged with the latch slots (114) to resist rotational movement of the downhole pump (22) relative to the pump seating nipple (20). In addition, the resilient arms (132) and latch members (122) are supported and engaged by the latch cavities (138) to facilitate the resistance of any relative rotational movement. Further, the sealing member (80) is concurrently axially aligned with the sealing surface (82) when the latch members (112) are engaged with the latch slots (114). Finally, the friction member (86) is also concurrently aligned with the friction surface (88) when the latch members (112) and the latch slots (114) are engaged.

To disengage the rotary downhole pump (22) from the pump seating nipple (20) for retrieval to the surface, an axial force or tension is applied to the downhole pump (22) in an upward direction or towards the surface. As a result, the latch members (112) are moved out of the latch slots (114), and the latch members (112) and the resilient arms (132) are further deflected into the latch cavities (138). The downhole pump (22) is then passed through the bore (56) of the pump seating nipple (20) and out of the proximal end (50). As the latch members (112) are moved out of the latch slots (114), the sealing member (80) and the friction member (86) are concurrently moved out of alignment with the sealing surface (82) and the friction surface (88) respectively.

With respect to the setting of a reciprocating downhole pump (20) in the pump seating nipple (20), the downhole pump (22) preferably includes only the reciprocating portion (24) having the axial force anchor device (76) and the seal device (78).

In order to set the reciprocating downhole pump (22) in the pump seating nipple (20), the downhole pump (22) is run or extended through the tubing string (48) from the surface to the pump seating nipple (20) downhole. The downhole pump (22) is received within the bore (56) of the pump seating nipple (20) and positioned such that the sealing member (80)

is axially aligned with the sealing surface (82) The friction member (86) is concurrently aligned with the friction surface (88).

To disengage the reciprocating downhole pump (22) from the pump seating nipple (20) for retrieval to the surface, an axial force or tension is applied to the downhole pump (22) in an upward direction or towards the surface. As a result, the sealing member (80) and the friction member (86) are concurrently moved out of alignment with the sealing surface (82) and the friction surface (88) respectively. The downhole pump (22) is then passed through the bore (56) of the pump seating nipple (20) and out of the proximal end (50).

What is claimed is:

1. A pump seating nipple for engagement with a downhole pump in order to seal and anchor the downhole pump relative to the pump seating nipple, wherein the downhole pump is a reciprocating pump or a rotary pump, the pump seating nipple having a proximal end, a distal end, and an internal surface defining a bore extending between the proximal end and the distal end for receiving the downhole pump, the pump seating nipple comprising:

(a) a nipple sealing component associated with the internal surface, for cooperating with a complementary pump sealing component associated with the downhole pump in order to provide a seal device between the pump seating nipple and the downhole pump;

(b) a nipple axial force anchoring component associated with the internal surface, for cooperating with a complementary pump axial force anchoring component associated with the downhole pump in order to provide an axial force anchor device for resisting axial movement of the downhole pump relative to the pump seating nipple; and (c) a nipple rotational force anchoring component associated with the internal surface, for cooperating with a complementary pump rotational force anchoring component associated with the downhole pump in order to provide a rotational force anchor device for resisting rotational movement of the downhole pump relative to the pump seating nipple, the rotational force anchor device comprising:

a latch member;

a complementary latch slot for engaging the latch member; and a resilient arm attached to the latch member for connecting the latch member with the downhole pump, wherein the latch member is biased toward the latch slot by the resilient arm when the downhole pump is received within the bore of the pump seating nipple so that the latch member is urged into engagement with the latch slot when the latch member is adjacent to the latch slot, and wherein the latch slot is defined by a proximal wall, a distal wall and two sidewalls in the internal surface of the pump seating nipple and wherein at least one of the sidewalls provides a latch slot torque bearing surface for engagement with a complementary latch member torque bearing surface on the latch member in order to resist rotational movement of the downhole pump relative to the pump seating nipple.

2. The pump seating nipple of claim 1 wherein the seal device comprises a sealing member and a complementary sealing surface and wherein the nipple sealing component comprises either the sealing member or the sealing surface.

3. The pump seating nipple of claim 2 wherein the nipple sealing component comprises the sealing surface.

4. The pump seating nipple of claim 1 wherein the axial force anchor device comprises a friction member and a complementary friction surface and wherein the nipple axial force anchoring component comprises either the friction member or the friction surface.

5. The pump seating nipple of claim 4 wherein the nipple axial force anchoring component comprises the friction surface.

6. The pump seating nipple of claim 4 wherein the seal device comprises a sealing member and a complementary sealing surface and wherein the nipple sealing component comprises either the sealing member or the sealing surface.

7. The pump seating nipple of claim 6 wherein the axial force anchor device and the seal device are comprised of a combined seal and axial force anchor device.

8. The pump seating nipple of claim 7 wherein the nipple sealing component and the nipple axial force anchoring component are comprised of a combined seal and axial force anchoring surface.

9. The pump seating nipple of claim 1 wherein the latch member and the latch slot are configured so that rotational movement of the downhole pump relative to the pump seating nipple is resisted when the latch member is engaged with the latch slot, and wherein the nipple rotational force anchoring component comprises either the latch member or the latch slot.

10. The pump seating nipple of claim 9 wherein the nipple rotational force anchoring component comprises the latch slot.

11. The pump seating nipple of claim 10 wherein the latch member of the rotational force anchor device is at least one of a plurality of latch members and the complementary latch slot of the rotational force anchor device is at least one of a plurality of complementary latch slots, and wherein the plurality of complementary latch slots are spaced circumferentially around the internal surface of the pump seating nipple.

12. The pump seating nipple of claim 11 wherein each of the plurality of latch slots is defined by a proximal wall, a distal wall and two sidewalls in the internal surface of the pump seating nipple and wherein at least one of the sidewalls provides a latch slot torque bearing surface for engagement with a complementary latch member torque bearing surface on one of the plurality of complementary latch members in order to resist rotational movement of the downhole pump relative to the pump seating nipple.

13. The pump seating nipple of claim 12 wherein both of the sidewalls of each of the plurality of latch slots provide latch slot torque bearing surfaces for engagement with complementary latch member torque bearing surfaces on the plurality of complementary latch members in order to resist rotational movement of the downhole pump relative to the pump seating nipple.

14. The pump seating nipple of claim 1 wherein both of the sidewalls of the latch slot provide latch slot torque bearing surfaces for engagement with complementary latch member torque bearing surfaces on the latch member in order to resist rotational movement of the downhole pump relative to the pump seating nipple.

15. A system for connecting a rotary downhole pump with a pump seating nipple, the system comprising a rotational force anchor device for resisting rotational movement of the downhole pump relative to the pump seating nipple, the rotational force anchor device comprising:

(a) a latch slot associated with one of the pump seating nipple and the downhole pump; and (b) a latch member associated with the other of the pump seating nipple and the downhole pump, for engaging the latch slot; wherein the latch slot and the latch member are complementary and are configured so that rotational movement of the downhole pump relative to the pump seating nipple is resisted when the latch member is engaged with the latch slot, wherein the pump seating nipple has a proximal end, a distal end, and an internal surface defining a bore extending between the proximal end and the distal end for receiving the downhole pump, wherein the downhole pump has an external surface, wherein the latch slot is associated with one of the internal surface of the pump seating nipple and the external surface of the downhole pump, and wherein the latch member is positioned between the internal surface of the seating nipple and the external surface of the downhole pump when the downhole pump is received within the bore of the pump seating nipple, and wherein the latch slot is defined by a proximal wall, a distal wall and two sidewalls, wherein at least one of the sidewalls provides a latch slot torque bearing surface, wherein the latch member has a proximal end, a distal end and two side edges, and wherein at least one of the side edges provides a latch member torque bearing surface which is complementary to the latch slot torque bearing surface.

16. The system of claim 15 wherein both of the sidewalls of the latch slot provide latch slot torque bearing surfaces and wherein both of the side edges of the latch member provide latch member torque bearing surfaces which are complementary to the latch slot torque bearing surfaces.

17. The system of claim 15 wherein the latch slot is associated with the pump seating nipple and wherein the latch member is associated with the downhole pump.

18. The system of claim 17 wherein the latch slot is defined by the internal surface of the pump seating nipple.

19. The system of claim 18 wherein the rotational force anchor device is further comprised of a resilient arm attached to the latch member for connecting the latch member with the downhole pump and wherein the latch member is biased toward the latch slot by the resilient arm when the downhole pump is received within the bore of the pump seating nipple so that the latch member is urged into engagement with the latch slot when the latch member is adjacent to the latch slot.

20. The system of claim 19 wherein the latch member is connected with the downhole pump such that the latch member and the resilient arm are positioned between the internal surface of the pump seating nipple and the external surface of the downhole pump and the resilient arm is deflected by the pump seating nipple when the downhole pump is received within the bore of the pump seating nipple, thereby biasing the latch member toward the latch slot.

21. The system of claim 20 wherein the downhole pump defines a latch cavity for the latch member and the resilient arm and wherein the latch member and the resilient arm are receivable in the latch cavity to accommodate the deflection of the resilient arm.

22. The system of claim 21 wherein the latch cavity is defined by two latch cavity sidewalls, wherein at least one of the latch cavity sidewalls provides a latch cavity torque bearing surface, wherein the resilient arm has two resilient arm side edges, and wherein at least one of the resilient arm side edges provides a resilient arm torque bearing surface which is complementary to the latch cavity torque bearing surface, so that the latch cavity supports the resilient arm in order to resist rotation of the downhole pump relative to the pump seating nipple when the latch member is engaged with the latch slot.

23. The system of claim 20 wherein the latch slot is at least one of a plurality of latch slots, the latch member is at least one of a plurality of complementary latch members, and the resilient arm is at least one of a plurality of resilient arms, wherein the plurality of resilient arms connect the plurality of complementary latch members with the downhole pump.

24. The system of claim 23 wherein the plurality of latch slots are spaced circumferentially around the internal surface of the pump seating nipple.

25. The system of claim 24 wherein the rotational force anchor device is further comprised of a collet surrounding the downhole pump and wherein the collet comprises the plurality of complementary latch members and the plurality of resilient arms.

26. The system of claim 25 wherein the downhole pump defines a plurality of latch cavities for the plurality of complementary latch members and the plurality of resilient arms and wherein the plurality of complementary latch members and the plurality of resilient arms are receivable in the plurality of latch cavities to accommodate the deflection of the plurality of resilient arms.

27. The system of claim 26 wherein each of the plurality of latch cavities is defined by two latch cavity sidewalls, wherein at least one of the latch cavity sidewalls provides a latch cavity torque bearing surface, wherein the plurality of resilient arms each have two resilient arm side edges, and wherein at least one of the resilient arm side edges provides a resilient arm torque bearing surface which is complementary to the latch cavity torque bearing surface, so that the latch cavities support the plurality of resilient arms in order to resist rotation of the downhole pump relative to the pump seating nipple when the plurality of complementary latch members are engaged with the latch slots.

28. The system of claim 27 wherein the rotational force anchor device is further comprised of a collet retainer for retaining the collet on the downhole pump.

29. The system of claim 28 wherein the collet retainer is threadably connected with the downhole pump.

30. The system of claim 23, further comprising a seal device for providing a seal between the pump seating nipple and the downhole pump.

31. The system of claim 30 wherein the seal device comprises a sealing member associated with one of the pump seating nipple and the downhole pump and a complementary sealing surface associated with the other of the pump seating nipple and the downhole pump and wherein the sealing member is positioned between the internal surface of the pump seating nipple and the external surface of the downhole pump when the downhole pump is received within the bore of the pump seating nipple.

32. The system of claim 31 wherein the sealing member is axially aligned with the sealing surface when the plurality of complementary latch members are engaged with the plurality of latch slots.

33. The system of claim 32, further comprising an axial force anchor device for resisting axial movement of the downhole pump relative to the pump seating nipple.

34. The system of claim 33 wherein the axial force anchor device comprises a friction member associated with one of the pump seating nipple and the downhole pump and a complementary friction surface associated with the other of the pump seating nipple and the downhole pump and wherein the friction member is positioned between the internal surface of the pump seating nipple and the external surface of the downhole pump when the downhole pump is received within the bore of the pump seating nipple.

35. The system of claim 34 wherein the friction member is aligned with the friction surface when the plurality of complementary latch members are engaged with the plurality of latch slots.

36. The system of claim 35 wherein the axial force anchor device and the seal device are comprised of a combined seal and axial force anchor device.

37. The system of claim 36 wherein the combined seal and axial force anchor device comprises a combined sealing and friction surface associated with the internal surface of the pump seating nipple and a combined seal and friction member associated with the downhole pump.

38. A pump seating nipple for engagement with a downhole pump in order to seal and anchor the downhole pump relative to the pump seating nipple, wherein the downhole pump is a reciprocating pump or a rotary pump, the pump seating nipple having a proximal end, a distal end, and an internal surface defining a bore extending between the proximal end and the distal end for receiving the downhole pump, the pump seating nipple comprising:

(a) a nipple sealing component associated with the internal surface, for cooperating with a complementary pump sealing component associated with the downhole pump in order to provide a seal device between the pump seating nipple and the downhole pump;

(b) a nipple axial force anchoring component associated with the internal surface, for cooperating with a complementary pump axial force anchoring component associated with the downhole pump in order to provide an axial force anchor device for resisting axial movement of the downhole pump relative to the pump seating nipple; and (c) a nipple rotational force anchoring component associated with the internal surface, for cooperating with a complementary pump rotational force anchoring component associated with the downhole pump in order to provide a rotational force anchor device for resisting rotational movement of the downhole pump relative to the pump seating nipple, wherein the rotational force anchor device comprises a latch member and a complementary latch slot for engaging the latch member, and wherein the latch slot is defined by a proximal wall, a distal wall and two sidewalls in the internal surface of the pump seating nipple and wherein at least one of the sidewalls provides a latch slot torque bearing surface for engagement with a complementary latch member torque bearing surface on the latch member in order to resist rotational movement of the downhole pump relative to the pump seating nipple.

* * * * *